United States Patent [19]

Sandkvist

[11] Patent Number: 5,051,181

[45] Date of Patent: Sep. 24, 1991

[54] DEVICE FOR TAKING UP FLOATING SUBSTANCES FROM A FLUID

[75] Inventor: Jim Sandkvist, Partille, Sweden

[73] Assignee: AB Sandvik Process Systems, Sweden

[21] Appl. No.: 411,477

[22] PCT Filed: Mar. 9, 1988

[86] PCT No.: PCT/SE88/00112

§ 371 Date: Sep. 26, 1989

§ 102(e) Date: Sep. 26, 1989

[87] PCT Pub. No.: WO88/07000

PCT Pub. Date: Sep. 22, 1988

[30] Foreign Application Priority Data

Sep. 3, 1987 [SE] Sweden ..... 8700693

[51] Int. Cl.[5] ..... E02B 15/04

[52] U.S. Cl. ..... 210/242.3; 210/242.4; 210/923; 210/924

[58] Field of Search ..... 210/242.3, 242.4, 923, 210/924, 776

[56] References Cited

U.S. PATENT DOCUMENTS

| | | | |
|---|---|---|---|
| 3,536,199 | 10/1970 | Cornelius | 210/242 |
| 3,812,968 | 5/1974 | Aramaki et al. | 210/242.3 |
| 3,947,360 | 3/1976 | Fast | 210/923 |
| 4,105,554 | 8/1978 | Janson | 210/242.3 |
| 4,165,282 | 8/1979 | Bennett et al. | 210/242.3 |
| 4,322,294 | 3/1982 | Price | 210/242.3 |

FOREIGN PATENT DOCUMENTS

| | | |
|---|---|---|
| 2378905 | 9/1978 | France . |
| 52-30974 | 3/1977 | Japan . |
| 152204 | 5/1985 | Norway . |
| 152617 | 7/1985 | Norway . |
| 157342 | 11/1987 | Norway . |

*Primary Examiner*—Stanley S. Silverman
*Assistant Examiner*—Christopher Upton
*Attorney, Agent, or Firm*—Ostrolenk, Faber, Gerb & Soffen

[57] ABSTRACT

A device for taking up substances floating in or on the surface of a fluid, which substances at a relative movement between the device and the fluid are brought to at least one uptaking machine (11), which is partly immersed in the fluid. The purpose is to provide an uptaking device, which i.a. shall: prevent the creation of a wash when the uptaking device moves in the forward direction through the mass of water, be simple to manufacture and operate, and easily adjustable in height and laterally and have a high taking up capacity. These tasks have been solved in that at least a portion of the immersed part (19) of the uptaking machine (11) in the fluid is surrounded by at least one screening off and deflecting member (20), which is arranged to create in the fluid around said immersed part (19) a protected zone (22) and controlled flow of the substance to the immersed part of the uptaking machine.

11 Claims, 3 Drawing Sheets

DEVICE FOR TAKING UP FLOATING SUBSTANCES FROM A FLUID

The present invention refers to a device for taking up substances floating in or on the surface of a fluid, which substances at a relative movement between the device and the fluid are brought to at least one uptaking machine, which is partially immersed in the fluid.

BACKGROUND OF THE INVENTION

A machine commonly used for taking up e.g. oil from water is constituted by a belt uptaking machine, comprising an endless, inclined belt, the lower end of which is immersed in the water, and where the oil shall adhere to the ascending belt part of the rotating belt. At the other, upper end of the belt uptaking machine there is provided a device for scraping off oil from the belt. These belt uptaking machines are commonly installed in specialized ships, where the belt may be arranged in the upstream or downstream direction.

Under certain operational conditions the rotation of these belts counteract their own function. Most belt uptaking machines are intended for taking up from the front, like an elevator, where oil, often by means of booms, is collected and supplied to the belt and the oil thereupon is conveyed further upwards along the belt. The inlet system of these belt uptaking machines has proven itself to have some serious drawbacks, based on the fact that it is easily affected by the waves, thus that the taking up capacity is considerably reduced, although the speed has been reduced to below one knot. The problem is that the belt uptaking machine generates a wash, partly because the belt at its movement upwards "tears" along water, and partly because a counterpressure wash is formed when the uptaking means moves up and down through the mass of water. The water film thereby created by the wash efficiently prevents oil from adhering to the belt.

PURPOSE AND MOST ESSENTIAL FEATURES OF THE INVENTION

The purpose of the present invention is to provide an uptaking device, which:

a) allows such inflow of oil to the inlet of the uptaking device, that the oil is not "teared" (urged) down below the water surface, b) is not affected by the waves, thus that the adherence of the oil to the belt is not disturbed to any appreciable degree, c) prevents the creation of a wash when the uptaking device moves forward through the fluid, d) allows oil lumps, solid contaminants, etc. to enter the device and to be conveyed through the system, e) shall be designed in such a manner, that oil afloat on the water within rather a big radius around the inlet opening, is pulled towards this, f) can take care of oil of different viscosities (highly viscous as well as heavy oil), g) is designed so that oil which has not been taken up or has escaped from the belt is moved back to the taking up position, h) is easy to manufacture and operate, i) is easily adjustable in height and laterally, k) has a high uptaking capacity.

These tasks have been solved in that at least a portion of the immersed part of the uptaking machine in the fluid is surrounded by at least one screening off and deflecting member, which is arranged to create in the fluid around said immersed part a protected zone and controlled flow of the oil to the belt.

DESCRIPTION OF THE DRAWINGS

The invention herebelow will be further described with reference to the accompanying drawings, which show some embodiments.

DESCRIPTION OF EMBODIMENTS

Figure 1:
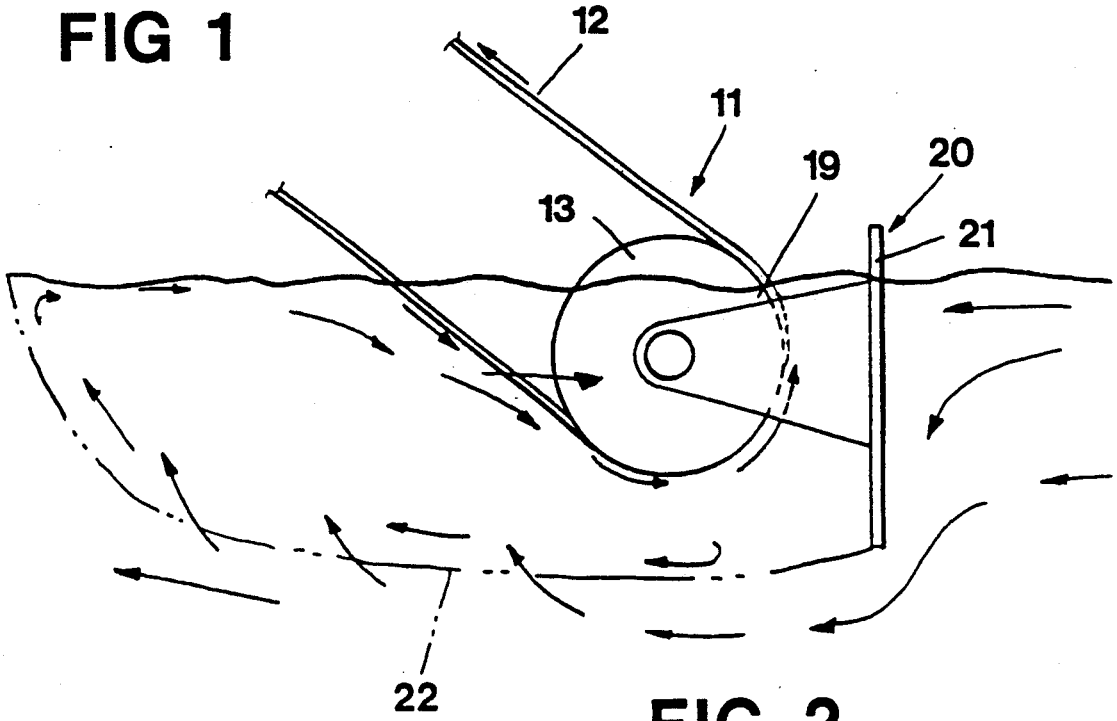
FIG. 1 is a schematic side view of the lower part of a device according to the invention, in its most simple form.

The description hereinafter will be strictly directed to taking up oil from a water surface, but the device according to the invention can as well be used for taking up other floating substances from an arbitrary fluid.

The uptaking device according to the invention incorporates an uptaking machine 11, which in a known manner consists of an endless belt 12, e.g. a latticed steel belt, which is arranged around a lower roller 13 and an upper roller 14, which is driven in a manner not further shown. At the upper part of the belt is provided a scraper 15 and/or a pressing roller 16, which prevent the oil from following the return part of the belt. By means of a gutter 17 the oil that has been conveyed upwards is moved away to a collecting container 18.

Figure 2:
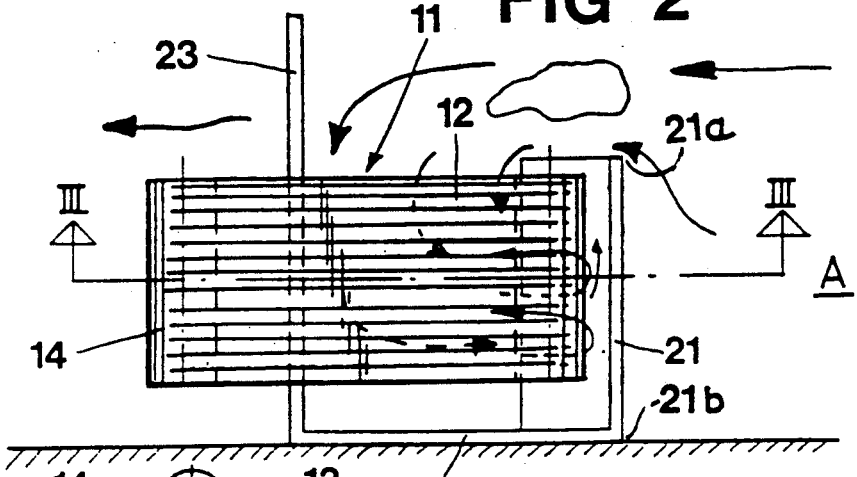
FIG. 2 shows a modified variant of the device according to the invention in a view from above.

Hereinafter the uptaking device is described when arranged in a ship, which causes a relative movement to the water. Of course it also is possible to arrange the device stationary in a flowing fluid. At conventional belt uptaking machines there is created in front of the lower belt roller 13, as seen in the flow direction a pressure side and behind the belt roller a suction side. The rotational movement of the belt as well as the motion of the ship creates a wash on the ascending belt part 12, which releases a water film, preventing oil from adhering to the belt 12. In order to attend to this problem it is according to the invention suggested as a first essential step, to provide at least one deflection member 20 in front of the part 19 of the uptaking machine 11, which is immersed in the water. In the embodiment shown in FIG. 1 this deflection member 20 is constituted by a frontal screen or obstruction 21, which may be pivotably connected to the uptaking machine 11, thus that it may occupy different height and inclination positions. By means of this frontal screen it is created behind it a protected zone 22, in FIG. 1 shown with dash-dot lines, and to which zone is supplied surface water mainly from the side, i.e., around side edge 21*a* (FIG. 2), thus that a controlled flow is generated, whereas the protected zone to a lower extent is filled from below. As illustrated in FIG. 2, a substantial portion of the floating substance is caused to flow from a point A (which is essentially directly in front of the substance removing means 11), around the edge 21*a*, and then toward the substance removing means 11.

The deflection member 20 may also incorporate a rearward screen or obstruction 23 arranged downstream of the immersed part 19 of the uptaking machine 11, just about at the position where the protected zone 22 ends and continues in a normal flow, whereby is obtained an increase of the controlled flow within the protected zone 22. The direct flow is utilized partly for obtaining a continuous adherence of oil to the taking up zone of the belt and partly for creating a recirculation of oil, which for different reasons has not been taken up at the first taking up attempt. In order further to improve the flow in the protected zone, it is possible to arrange, in the embodiment of the device shown in FIGS. 2 and 3, on one side of the protected zone a side screen or obstruction 24 between the frontal screen 21 and the rear screen 23, which side screen makes possible a controlled collecting of oil, in that the protected zone is bordered on three sides. This zone also serves as a balancing buffer.

Figure 3:
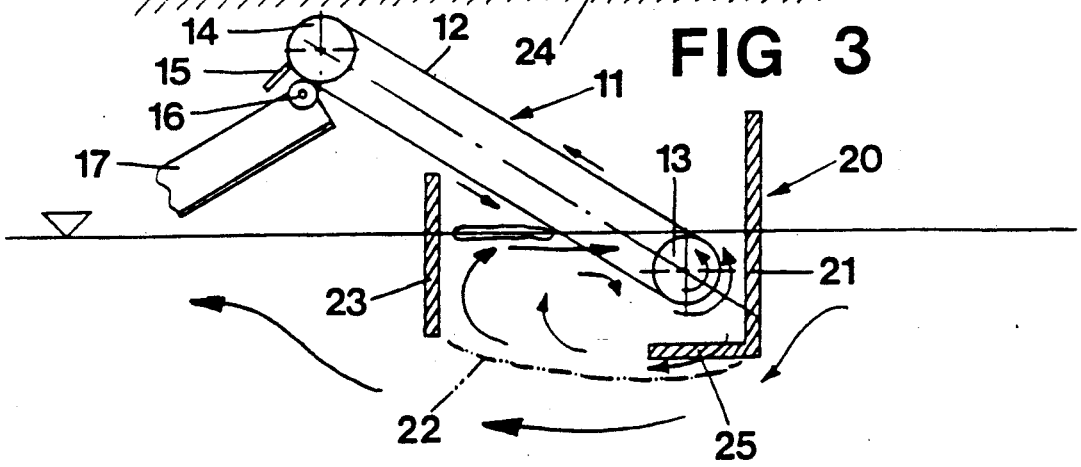
FIG. 3 shows a section along line III—III in FIG. 2.

The uptaking device according to the invention shall also be usable in very shallow waters and in order to prevent that water passing below will penetrate up into the protected zone below the roller 13 and wash away adhering oil, a bottom screen or obstruction 25 is arranged just opposite to the immersed part of the uptaking machine, i.e. just in front of the roller 13, which bottom screen may be tightly attached to the frontal screen 21 in the embodiment shown in FIGS. 2 and 3.

It also is essential that the screens 21, 23, 24 and 25 are not located too close to the uptaking machine 11, as the flow created in the lee zone otherwise is reduced, which has been found to be particularly critical when thicker oil shall be taken up. A slot width smaller than 10 cm should be avoided. In trials it furthermore has been found that the bottom screen 25, which is effective as an erosion protection, must not cover the entire bottom of the protected zone, as the passage of water is otherwise prevented resulting in a capacity reducing ponding. A covering bottom furthermore during heave of the sea may effectively flush out oil collected, whereby there generally spoken shall be only few movement damping horizontal surfaces within the protected zone.

The rearward screen 23 can consist, e.g. of a flexible screen, e.g. a boom, in order to avoid sharp corners, where may be created whirls, which have a negative effect on the desired water movement in the surface water in the protected zone.

Figure 4:
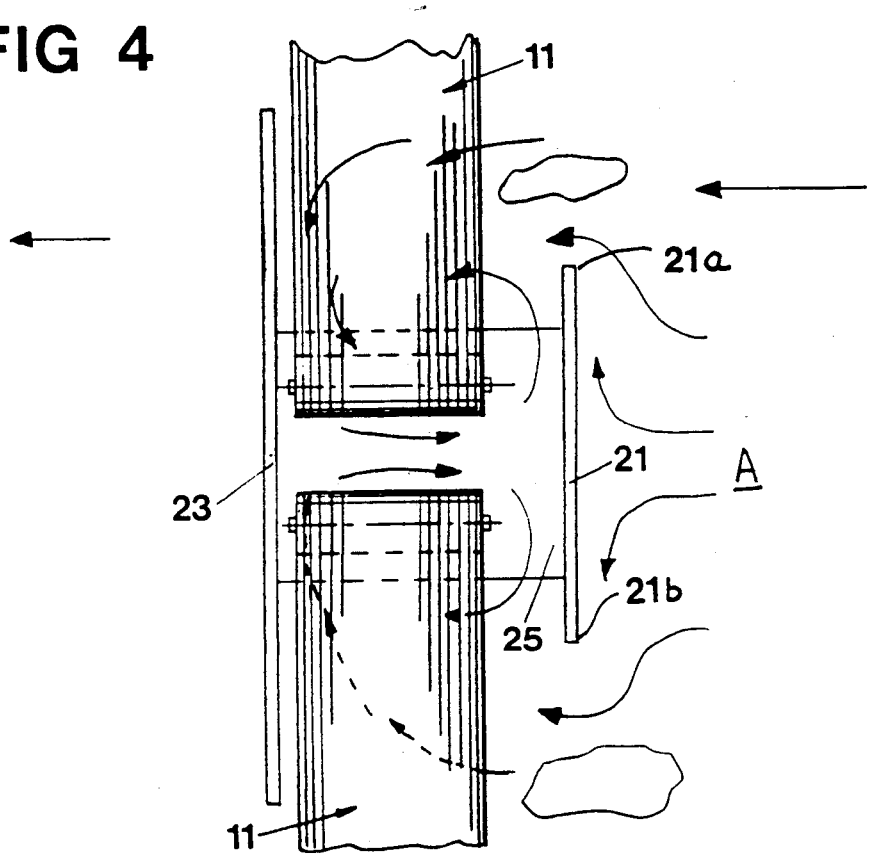
FIG. 4 shows further an embodiment of the invention provided with double uptaking machines in a view from above.
Figure 6:
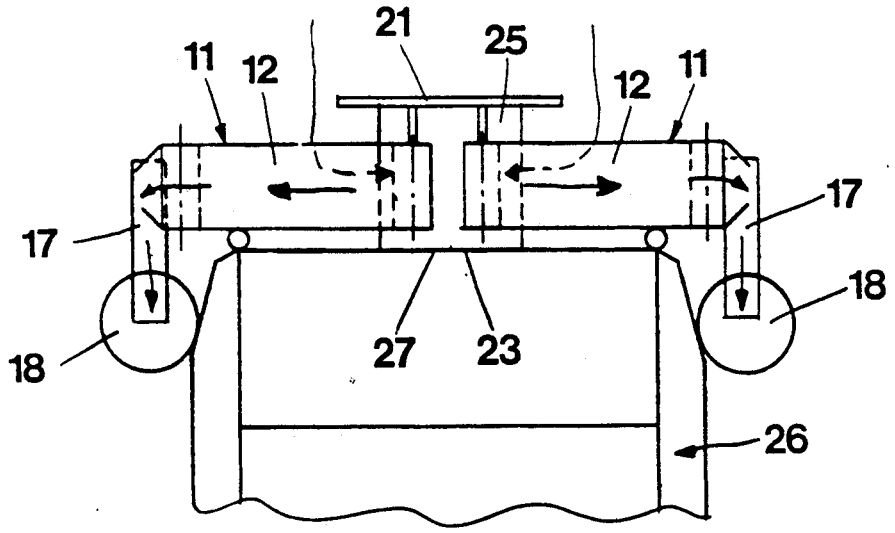
FIGS. 6 and 7 show the device according to FIGS. 4 and 5 mounted at the stem of a ship in a view from above and in a front view.

In the embodiment according to FIGS. 4 and 6, there are two uptaking machines 11 arranged perpendicularly to the flow direction of the water. As in the embodiment illustrated in FIG. 2, a substantial portion of the floating substance is caused to flow from point A, around edges 21*a*, 21*b*, and then toward the substance removing means. The immersed parts 19 of the uptaking machines are situated rather near and parallel to each other, but far enough from each other not to disturb the flows created around each part 19. The same details in this embodiment have been given the same reference numerals as in the preceeding embodiment. In this embodiment the bottom screen 25 is thus arranged centrally under the immersed parts of both machines, whereas the side screens 24 are omitted. A lateral screen may be present as a partition between the two uptaking machines.

Figure 5:
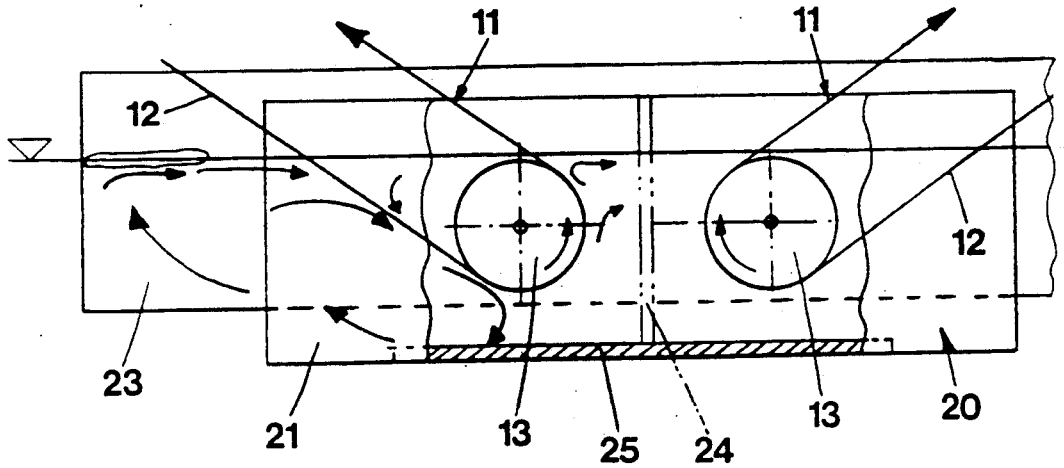
FIG. 5 shows the device according to FIG. 4 in a front view in bigger scale and partly in section.
Figure 7:
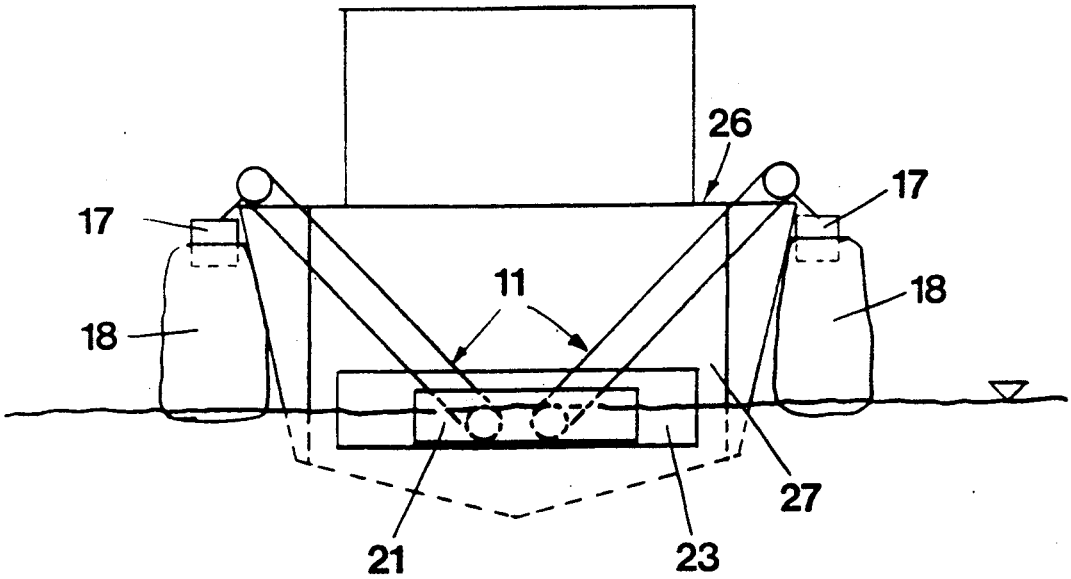

In the embodiment according to FIGS. 6 and 7, the uptaking machines 11 are arranged in the manner shown by FIGS. 4 and 5. In this embodiment the plane stem of the ship also may constitute the rearward screen 23 of the zone 22. The uptaking device is preferably designed as a separate unit, e.g. in the form of a box system, which in a simple manner, when needed can be mounted on the forebody of an appropriate ship. In the embodiment shown the scraping device is located outside the ship's hull, where oil which is taken up is collected directly in specially developed oil bags. The suspending device for the bags can be designed as a box system, wherein a filled bag is exchanged for a new bag without the operation being interrupted. The filled bag is lifted aboard or is anchored free-floating at the side of the hull for being transported away later.

The front screen 21 may be designed as a float for taking up a certain portion of the device weight and is preferably streamlined for reducing the water resistance.

The uptaking machine 11 hereinafter has been described as a belt uptaking machine, but the invention can with equal advantage be used with other types of uptaking machines, e.g. so called adhesion skimmers consisting of a plurality of rotating discs, to which the oil adheres, and where the oil is scraped off above the water surface and is deposited in a collecting gutter. Also pumps floating on the water surface, which pump up the oil film from the water is a possible alternative. Trials that have been made with the uptaking device according to the invention have shown a high capacity of taking up oil, and it not only can take up oil within a rather narrow viscosity interval but from oils of very low viscosity up to heavy oils. The device also operates in rough and choppy sea as it creates a protected zone. The cleaning of the uptaking device presents no difficulties, as it consists only of smooth screens beside the uptaking belt, which can be easily washed clean.

The invention is not limited to the embodiments shown variants are possible within the scope of the claims.

I claim:

1. A fluid handling system, comprising:

substance removing means for removing a substance which is floating in or on the surface of a fluid, the substance removing means including a portion which is immersed in the fluid, the immersed portion of the substance removing means including a lower edge;

means for providing relative movement between the substance removing means and the fluid such that the fluid flows relatively toward the front of the substance removing means; and deflecting means for creating a protected zone in the fluid around the immersed portion of the substance removing means and for creating a directed rotational flow within the surface of the fluid such that the floating substance flows toward the immersed portion of the substance removing means, the deflecting means including a front obstruction which is located in front of the substance removing means, the front obstruction extending above the floating substance and below the surface of the fluid, the front obstruction having a lower edge and first and second side edges, the lower edge being at least as low as the lower edge of the immersed portion of the substance removing means, the distance between the side edges being greater than the width of the front of the immersed portion of the substance removing means, the front obstruction being arranged to obstruct the relative flow of the fluid toward the front of the substance removing means and to thereby cause the relative flow of the floating substance to be from a point which is essentially directly in front of the substance removing means, around the first side edge of the front obstruction, and then toward the immersed portion of the substance removing means.

2. A device as claimed in claim 1, wherein the front screen obstruction is substantially perpendicular to the relative flow of the fluid toward the front of the substance removing means.

3. A device as claimed in claim 2, wherein the front screen obstruction is vertically adjustable.

4. A device as claimed in claim 1, wherein the deflecting means includes a rear obstruction which is wider than the front obstruction, the protected zone being located between the front and rear obstructions the rear obstruction being spaced apart from the immersed portion of the substance removing means an amount sufficient to maintain the directed rotational flow within the protected zone.

5. A device as claimed in claim 4, wherein the deflecting means includes a side obstruction which is located between the front and rear obstructions the protected zone being located betwen the front, rear and side obstructions, the side obstruction being spaced apart from the immersed portion of the substance removing means an amount sufficient to maintain the directed rotational flow within the protected zone.

6. A device as claimed in claim 4, wherein the deflecting means includes a bottom obstruction which is connected to the front obstruction, the bottom obstruction being lower than the lower edge of the immersed portion of the substance removing means, the protected zone being located between the front, rear and bottom obstructions.

7. A device as claimed in claim 6, wherein the bottom obstruction is no wider than the front obstruction.

8. A device as claimed in claim 4, wherein the substance removing means includes a belt conveyor.

9. A device as claimed in claim 9, wherein the belt conveyor is adapted to lift the floating substance up and rearwardly away from the surface of the fluid.

10. A device as claimed in claim 4, wherein the substance removing means includes a pair of belt conveyors for lifting the floating substance up and in opposite directions away from the surface of the fluid.

11. A device as claimed in claim 4, wherein the relative movement providing means includes means for moving the substance removing means and the deflecting means through the fluid.

* * * * *